United States Patent [19]

Jakobs

[11] 4,088,273

[45] May 9, 1978

[54] COMMINUTION MACHINE WITH A COMMINUTION ROTOR

[75] Inventor: Willy Jakobs, Cologne, Germany

[73] Assignee: Klöckner-Humboldt-Deutz Aktiengesellschaft, Germany

[21] Appl. No.: 776,782

[22] Filed: Mar. 11, 1977

[30] Foreign Application Priority Data

Apr. 3, 1976 Germany ..... 2614552

[51] Int. Cl.[2] ..... B02C 18/22

[52] U.S. Cl. ..... 241/35; 241/186 R; 241/239

[58] Field of Search ..... 241/35, 186 R, 186.2, 241/222, 224, 225, 189 R, 189 A, 239–241

[56] References Cited

U.S. PATENT DOCUMENTS

| | | | |
|---|---|---|---|
| 3,058,677 | 10/1962 | Linzberger | 241/222 |
| 3,587,983 | 6/1971 | Heinrich | 241/189 R X |
| 3,813,048 | 5/1974 | Lehr | 241/224 |
| 3,857,519 | 12/1974 | Schafer et al. | 241/189 R X |

FOREIGN PATENT DOCUMENTS

| | | | |
|---|---|---|---|
| 2,441,675 | 3/1976 | Germany | 241/186 R |

*Primary Examiner*—Roy Lake
*Assistant Examiner*—Howard N. Goldberg
*Attorney, Agent, or Firm*—Hill, Gross, Simpson, Van Santen, Steadman, Chiara & Simpson

[57] ABSTRACT

A comminution machine has a comminution rotor and a crushing edge between which is formed a crushing gap for breaking a charge of material. An adjustable rocker arm is provided which has an adjustable spacing from the comminution rotor which is independent of the crushing gap.

12 Claims, 3 Drawing Figures

COMMINUTION MACHINE WITH A COMMINUTION ROTOR

BACKGROUND OF THE INVENTION

The invention relates to a comminution machine with a comminution rotor and a crushing edge forming a crushing gap with the same wherein a rocker arm is arranged in the region of the material charge.

Comminution machines of the above type have the advantage, depending upon the machine hardware, particularly in the material charging area, of being adaptable to solve a variety of comminution problems. Such machines have, for example, proved satisfactory in the comminution of medium hard bulk or loose material such as potassium salt, etc.

However, for comminution of refuse, particularly for refuse containing bulk items, comminution machines having a comminution rotor may be utilized economically.

For the comminution of large pieces of charging material in discontinuous charging rhythm, the charging of the previous comminution machines took place through supply bunkers and charging conveyors. If, however, the size of the pieces or lumps in the charging material exceeded a certain size, then with reference to the bunker discharge and the charging conveyors, a coarse comminution apparatus must be placed in series before the comminution machine. This solution of the problem has the disadvantage of lacking economy.

Another difficulty results with the comminution of bulk material, such as refuse, if the dimensions of the comminution machine in the area of the material charging, particularly in the space between a rocker arm and comminution rotor, limits the size of the individual pieces of the charging portions to be crushed, or if clogging of the material charging shaft occurs as a result of portions of the charge which are too bulky.

SUMMARY OF THE INVENTION

It is an object of the invention to overcome these and similar difficulties and to provide a comminution machine having a continuous crushing capability range with discontinuous charging while omitting supply or storage bunkers and charging conveyors. Furthermore, in the case of comminution of bulky material, the invention should permit the input of large individual pieces. Another object of the invention is to eliminate the need for the previous uneconomical solutions, such as an initial coarse comminution step, charging by means of bunkers and charging conveyors, as well as the use of individual machine sizes adapted for the comminution of materials of various sizes.

In accordance with the invention, a rocker arm is arranged to be adjustable independently of the adjustment of the crushing discharge as defined by the spacing from the comminution rotor.

In an embodiment of the invention, the rocker arm is slidably arranged approximately axially parallel with the comminution rotor. However, it may also be suitable to arrange the rocker arm in swingable fashion.

With an embodiment of the invention, the rocker arm is arranged in a slidable support. In this connection, it may be of advantage that the rocker arm is mounted in hinged fashion and/or supported elastically.

There also is, however, a suitable arrangement according to the invention wherein the rocker arm is arranged as a slidable wall of the charging shaft.

The advantage of this embodiment for a comminution machine with a comminution rotor according to the invention, lies in that the charging shaft or region, on account of the slidability of the wall area formed by the rocker arm with respect to the comminution rotor, may assume timewise a much larger cross-section than is possible with an equally large machine with a rigidly arranged rocker arm.

A further advantageous feature of the invention is that the thrust or feed device is driven by a motor.

The invention differs from known comminution machines with adjustable rotating rocker arms. For example, in the case of coarse reduction impact crushers in which with the adjustability of the rocker arm is small in comparison with the invention, such small adjustment determines the size of the crushing discharge. In this connection, the adjustment according to the granular size of the finished material desired or the degree of wear on the impact capacities in the known comminution machines is carried out by hand.

In a further development of the invention, between the thrust or feed device and the rocker arm, or between the feed device and the support for the rocker arm, an elastic buffer is arranged.

From this results the advantage that the flexible support as well as the elastic support of the rocker arm in the abutment may be omitted, because the necessary elastic yield of the rocker arm with respect to the driving power of the comminution rotor is provided by the elastic buffer.

With an advantageous embodiment of the invention, the drive for the feed or thrust device takes place hydraulically by means of adjusting pistons. In this case, it is of advantage to correlate the hydraulic adjusting piston with an oil pressure reservoir. Such a combination acts like a hydropneumatic spring unit and consequently assumes the function of the elastic buffer.

A method for driving the comminution machine of the invention is characterized in that the advance or feed thrust of the rocker arm against the comminution rotor is established depending upon the torsional or twisting moment of the rotor. The determination of this torsional or twisting moment is preferably determined in a known manner by measuring the motor output of the driving machine. Through this technique it is insured that the comminution machine is optimally equalized without undergoing overloading during the entire comminution operation time.

DESCRIPTION OF THE PREFERRED EMBODIMENTS

Figure 1:
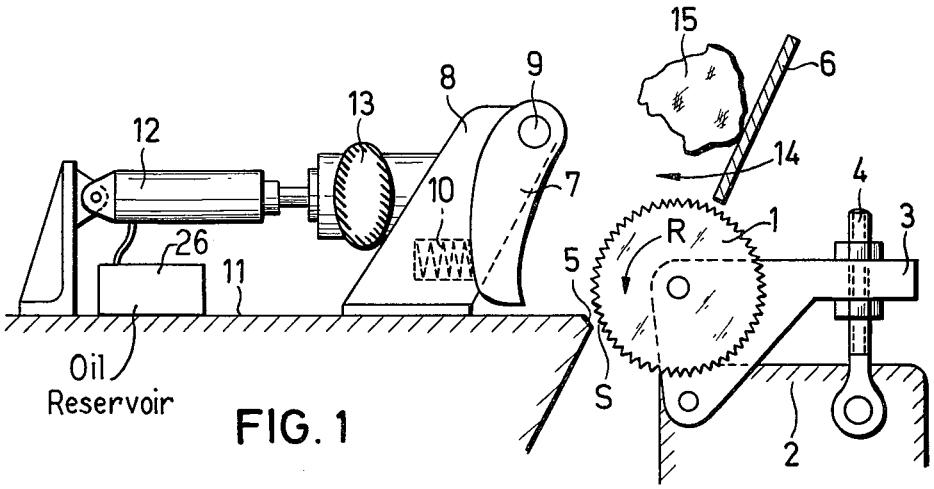
FIG. 1 shows a side view of a comminution machine according to the invention.

In accordance with FIG. 1, the communution rotor 1 is connected with a roller frame or supporting member 2 by means of a flexible arm 3. The flexible arm 3 is held by the supporting spindle 4 in such a position that between the comminution rotor 1 and a crushing edge 5, a predetermined crushing discharge S results. The direction of rotation of the comminution rotor is indicated by R. Above the comminution rotor 1 a rear part 6 of the charging region 14 is visible. Opposite the comminution rotor 1, a rocker arm 7 is connected with a support 8 in a hinge joint or articulation 9. An elastic support 10 makes it possible to balance the rocker arm elastically with the comminution rotor 1 in order to prevent overloads. The support 8 is guided in a machine bed or base 11 in a slideway not shown in greater detail, and is pushed forward or back, respectively, by a forward thrust device 12 in a horizontal direction against the comminution rotor 1. Between the motor-driven forward thrust or feed device 12 and the support 8 is arranged an elastic rubber buffer 13, which likewise serves the purpose of elastically damping hard impacts which results during crushing. The rocker arm 7 together with the rearward wall 6 forms a part of the charging shaft. In place of buffer 13 an oil pressure reservoir 26 may be employed for functioning as a hydropneumatic spring unit.

In the position of the rocker arm 7 shown in FIG. 1, the charging region 14 is large enough in cross-section in order to receive a bulky material 15 which is to be comminuted.

Figure 2:
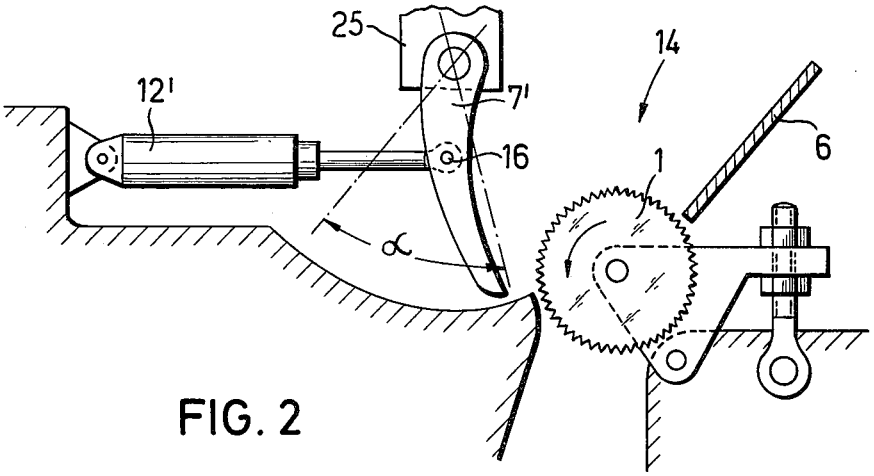
FIG. 2 shows a side view of another embodiment of the comminution machine of the invention.

FIG. 2 shows a similar embodiment of the comminution machine with a comminution rotor 1 as well as the rear wall 6 of the charging region 14. In this embodiment, a rocker arm 7′ is arranged which is dimensioned very large in relation to the comminution rotor 1. This rocker arm together with the rear wall 6 likewise forms a part of the charging region 14. This rocker arm 7′ is swingable in a further area or range such as by an angle $\alpha$ by virtue of its size and supporting structure 25, whereby a cross-section of the charging shaft or region or the material receiving chamber may be altered within wide limits. For this purpose, the rocker arm has a forward advance device 12′ which engages the rocker arm at a point of rotation 16.

Figure 3:
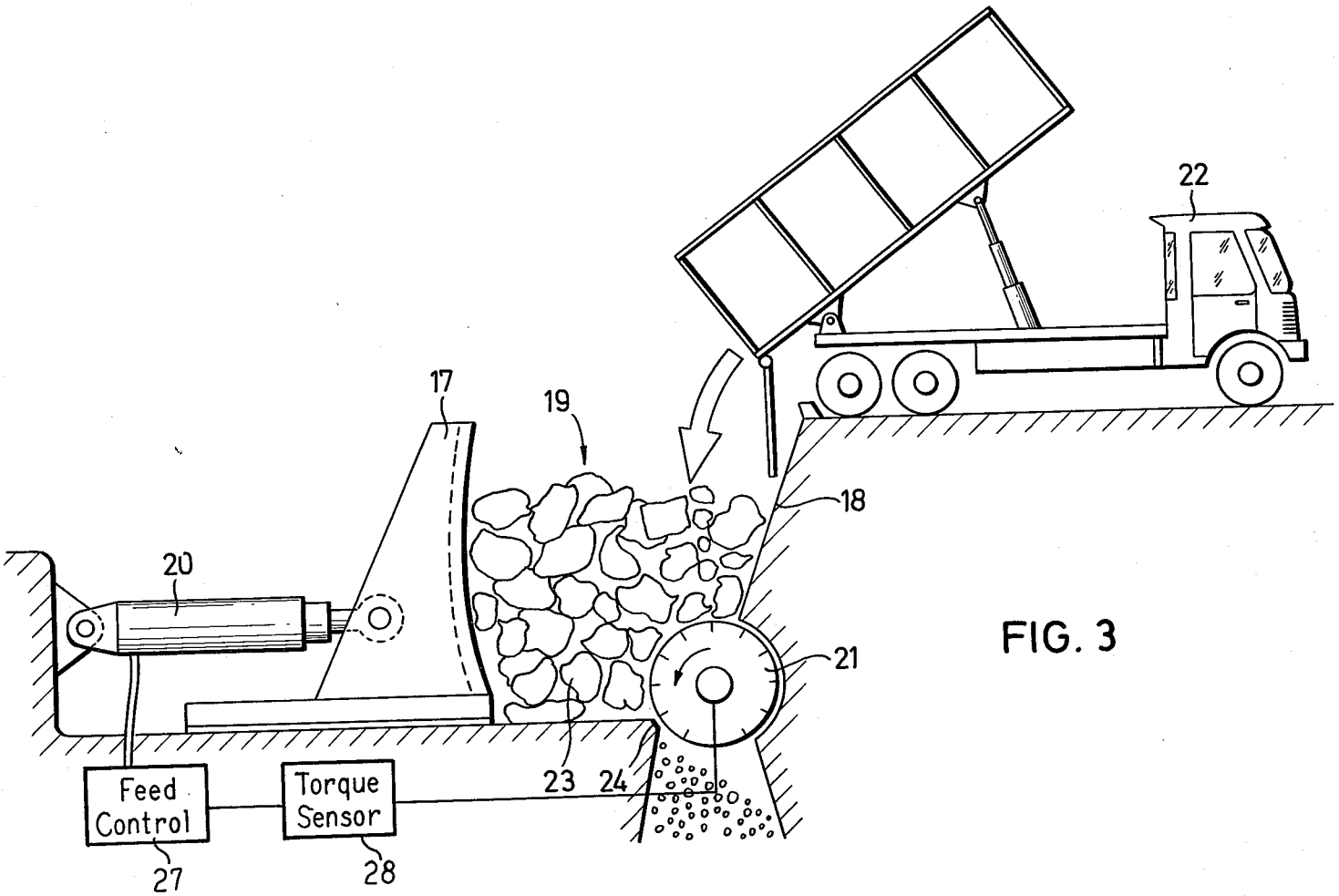
FIG. 3 shows a side view of a comminution installation with the comminution machine according to the invention in which discontinuous charging of bulk material occurs by use of a motor truck.

FIG. 3 shows an installation for the comminution of refuse including bulky refuse with a comminution machine in accordance with the invention. The rocker arm 17 in this arrangement is arranged to be rigid, although movable to and fro. Together with the rear wall 18 the rocker arm 17 forms the material charging region 19. The rocker arm 17 is pushed forward by the motor driven advance or feed device 20 against the comminution rotor 21.

The embodiment of FIG. 3 illustrates discontinuous filling of the charging region 19 by use of a motor truck 22 which tips over the contents of a loading platform into the charging region 19. The charging material is indicated by reference numeral 23. It is pressed by the rocker arm 17 against the comminution rotor 21 depending upon the torsional or twisting moment of the rotor and is comminuted between the comminution rotor 21 and the crushing edge 24. A torque sensor 28 senses the torque of rotor 21 and adjusts the feed control unit 27 and feed device 20 accordingly.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. A comminution machine comprising:
(a) a comminution rotor;
(b) a crushing edge forming with the comminution rotor a crushing gap, a material charging region being positioned above the gap;
(c) an adjustable rocker arm means for adjustment independently of the crushing gap, said rocker arm means being positioned in the material charging region at an adjustable spacing from the comminution rotor; and
(d) said rocker arm means being arranged in a slidable support.

2. A comminution machine according to claim 1, characterized in that the rocker arm means is flexibly supported on said support.

3. A comminution machine according to claim 1, characterized in that the rocker arm means is elastically supported on said support.

4. A comminution machine according to claim 1, characterized in that the rocker arm means is arranged as a slidable wall of the material charging region.

5. A comminution machine according to claim 1 in which the rocker arm means has a swingable rocker arm.

6. A comminution machine comprising:
(a) a comminution rotor;
(b) a crushing edge forming with the comminution rotor a crushing gap, a material charging region being positioned above the gap;
(c) an adjustable rocker arm means for adjustment independently of the crushing gap, said rocker arm means being positioned in the material charging region at an adjustable spacing from the comminution rotor;
(d) a motor driven feed device means for adjusting the rocker arm means; and
(e) arranging between the feed device means and the rocker arm means an elastic buffer.

7. A comminution machine according to claim 6 in which between the feed device means and a support retaining the rocker arm means is arranged an elastic buffer.

8. A comminution machine according to claim 6, characterized in that the drive of the feed device means takes place by means of a hydraulic adjusting piston.

9. A comminution machine according to claim 8, characterized in that an oil pressure reservoir is correlated with the hydraulic adjusting piston to form a hydropneumatic spring unit.

10. A comminution machine according to claim 9, characterized in that a torque sensing means and a feed control means are provided between the rotor and the feed device means for advance feed of the rocker arm against the comminution rotor in dependence upon the torque of the comminution rotor.

11. A comminution machine according to claim 10, characterized in that the torque sensing means senses the motor output of the comminution machine to determine appropriate advance feed.

12. A comminution machine, comprising:
(a) a comminution rotor;
(b) a crushing edge forming with the comminution rotor a crushing gap therebetween, a material charging region being positioned above the gap;
(c) an adjustable rocker arm means including a slidable support and a rocker arm connected to the support at a pivot point at one end of the rocker arm, said support being slidable towards the crushing gap;
(d) feed device means for sliding said support towards said crusher gap; and
(e) damping means for absorbing crushing shocks on said rocker arm.

* * * * *